United States Patent [19]

Richardson et al.

[11] Patent Number: 4,516,633

[45] Date of Patent: May 14, 1985

[54] BLIND SHAFT DRILLING

[75] Inventors: Paul Richardson, Santa Ana; Daniel C. Albers, El Toro; David A. Whitley, Brea, all of Calif.

[73] Assignee: Santa Fe International Corporation, Alhambra, Calif.

[21] Appl. No.: 303,511

[22] Filed: Sep. 18, 1981

[51] Int. Cl.[3] ..... E21D 13/06; E21B 17/18; E21B 17/10

[52] U.S. Cl. ..... 166/69; 166/213; 166/215; 166/325; 166/339

[58] Field of Search ..... 175/69, 213, 215, 325, 175/339

[56] References Cited

U.S. PATENT DOCUMENTS

| | | | |
|---|---|---|---|
| 1,575,945 | 3/1926 | Stroud | 252/25 |
| 1,721,004 | 7/1929 | Debose | 175/325 |
| 1,819,646 | 8/1931 | Loomis et al. | 175/72 |
| 2,823,900 | 2/1958 | Kandle | 175/325 |
| 3,297,100 | 1/1967 | Crews | 175/215 X |
| 3,655,001 | 4/1972 | Hoffman | 175/213 |
| 3,702,059 | 11/1972 | Jacoby | 175/72 |
| 3,713,488 | 1/1973 | Ellenburg | 175/215 |
| 3,788,405 | 1/1974 | Taylor | 175/72 |
| 4,190,123 | 2/1980 | Roddy | 175/325 |
| 4,289,632 | 9/1981 | Clear | 175/72 |
| 4,330,155 | 5/1982 | Richardson et al. | 299/11 |

OTHER PUBLICATIONS

20-Foot Diameter Blind Shaft Drilling, by Carone and Whitley, Sep. 20, 1980.

Oil Rigs Revamped for Coal Mine Use, Industry News, Feb. 11, 1980.

Composition and Properties of Oil Well Drilling Fluid, Rogers 3rd Edition ®1963.

*Primary Examiner*—Stephen J. Novosad

*Assistant Examiner*—Joseph Falk

*Attorney, Agent, or Firm*—LeBlanc, Nolan, Shur & Nies

[57] ABSTRACT

In the mining of various minerals from the earth, large mining shafts extending from the surface down to the deposited mineral layers or seams in the earth can be provided through the use of large diameter bore hole drilling equipment. With the drilling equipment stationed on the surface of the earth, a drilling member is drilled down into the earth for forming a shaft in excess of 10 feet to a depth of at least 2000 feet. As the earth is broken up during the drilling operation, the broken fragments are removed from the drilled hole by a reverse circulation drilling operation. During the drilling operation, the drilling bit is maintained in proper alignment with the shaft being drilled by the use of non-rotating stabilizers having an outer diameter substantially equal to the diameter of the hole being drilled. By maintaining fluid at a sufficient level in the drilled hole during the drilling operation, an adequate hydrostatic head can be created for exerting an opposing pressure on any zone of instability on the walls of the drilled hole for preventing inflow of water and debris.

34 Claims, 4 Drawing Figures

BLIND SHAFT DRILLING

RELATED APPLICATION

The present application is related to commonly assigned application Ser. No. 134,296 filed Mar. 26, 1980, now U.S. Pat. No. 4,330,155, and entitled BORE HOLE MINING. The subject matter of such prior application is hereby incorporated by reference.

BACKGROUND OF THE INVENTION

The present invention relates to the construction of large diameter mining shafts having a diameter in excess of 10 feet and extending to a depth of at least 2,000 feet for use in conjunction with the mining of mineral deposits.

Mining shafts have been constructed in connection with the mining of minerals to serve as access shafts to the mineral deposits and/or as air shafts to the underground mining tunnels. In both cases, such shafts have conventionally been constructed by what essentially amounts to a digging type technique. Typically all such shafts are constructed to extend along a vertical alignment which generally decreases sinking, maintenance and hoisting cost. The shafts can be constructed along an incline where necessary in order to decrease the distance for horizontal cross-cuts and for obtaining access to the layers of mineral deposits.

In sinking a shaft in rock, the shaft is typically formed by drilling various small holes which are then filled with a blasting material for blasting out the rock. This operation is followed by mucking, hoisting the broken rock and establishing ground support. Occasionally during this construction operation various sections of the shaft will be exposed to water permeable rocks thereby enabling water to sink into the shaft. Such water can be removed by the use of large pumps or by drilling holes down the side of the shaft being constructed and then filling such holes under high pressure with a cement mixture. In this manner the shaft is encircled by the cement mixture which penetrates the permeable rock surrounding the shaft so as to decrease the flow of water toward the shaft. Such an operation is occasionally referred to as cementation.

In sinking a shaft in soft ground, the operation first starts with driving either wood or steel spilings around the perimeter and ahead of the bottom of the shaft. The ground is then removed and a permanent wall support is installed. Next, a shaft lining material formed of wood, steel or concrete is constructed in the soft ground after which by way of a digging operation the earth is removed. Next, grout can be forced into the surrounding ground for reinforcing the side walls of the shaft.

In constructing relatively small holes within the earth such as in oil and gas well drilling, bore holes on the order of 60 inches in diameter have been drilled. Exemplary of drilling techniques and equipment used for such purposes is the apparatus described in U.S. Pat. No. 4,133,397. This patent also indicates that such equipment can be used in various mining and foundation forming operations. In the operation of the drilling system disclosed in such patent, the drill bit is rotated by a rotary drive mechanism while drilling fluid is circulated for cooling the drilling bits and for flushing cuttings from the cutting surfaces of the drilling bits and from the bore hole being drilled.

U.S. Pat. No. 4,102,415 also discloses an earth and rock bore drilling system for forming vertical shafts for mines or other subterranean installations. This patent discloses a conventional fluid circulation mechanism of the general type shown in FIG. 1 in the present application. This type of conventional fluid flow mechanism can be used in the drilling of relatively small bore holes. Such a circulation system, however, does not provide for an efficient or really practical operation in drilling large bore holes, i.e. holes in excess of 10 feet in diameter.

Various attempts have also been made at conducting drilling operations between various tunnels underground; exemplary of such attempts are the embodiments illustrated in U.S. Pat. Nos. 3,167,354 and 4,123,109. In addition, some attempts have been made at subterranean hydraulic mining of mineral deposits such as shown in U.S. Pat. Nos. 3,874,733 and 4,092,045. Furthermore, with respect to the process of mixing the mineral deposits, such as coal, in a slurry for the purposes of transportation along a pipeline, such techniques are shown in U.S. Pat. Nos. 3,041,053 and 3,924,895.

With the increasing necessity for economically and efficiently obtaining sources of energy, it has become even more critical for finding new techniques for use in the mining of minerals. Such problems are especially enhanced in light of the safety considerations in constructing mining shaft with conventional blasting and digging techniques.

SUMMARY OF THE INVENTION

An object of the present invention is to provide an improved procedure and associated equipment for constructing large mining shafts in excess of 10 feet in diameter in a more economic and efficient manner.

Another object of the present invention is to provide an improved procedure for constructing large mining shafts in excess of 10 feet in diameter that avoids the dangers involved with conventional mine shaft construction techniques.

A further object of the present invention is to provide a procedure for forming mine shafts for use in the mining of minerals utilizing large shaft diameter drilling equipment arranged on the surface of the earth.

Still another object of the present invention is to provide a system and technique for constructing large mine shafts in excess of 10 feet in diameter utilizing reverse direction drilling equipment with a high torque drill bit attached at the end of a drill string.

One of the most prominent advantage to shaft drilling over conventional shaft sinking is speed. In the New Mexico mineral belt, a 20-foot diameter shaft 3,500 feet deep can be expected to take four years to complete. The drilling methods in accordance with the present invention can cut this time down to one year, which includes the shaft lining operations. The reason for such drastic differences in time is that drilling incorporates penetration and muck removal into one continuous operation.

Another major advantage is that safety is significantly increased since men do not enter the shaft until it is completely lined. This also adds to speed of operations since adverse down hole conditions such as heat, water and humidity do not effect workers' performance.

On an economic basis, while shaft drilling is competitive to conventional shaft sinking looking only at the bottom line costs to construct a particular shaft, if the time value of money is considered, the scale leans heavily toward drilling methods. By employing drilling methods, a shaft can become productive in one-quarter the time it would take to sink conventionally.

Another advantage to shaft drilling is control of ground waters and unstable formations. These problems can seriously hinder conventional shaft sinkers, and in some cases, the costly procedures of ground freezing must be employed. When drilling, these problems are easily handled by manipulation of the drilling fluid. Such conditions are countered by weighting up the fluid. This increases the hydrostatic head which exerts an opposing pressure on the aquifer or zone of instability and prevents inflow of water and/or debris.

The three factors that affect penetration rates are bit weight, rotational speed of the bit and bit cleaning. Of these bit cleaning is the most significant. This is due to the ratio of already broken material to fresh formation exposed to the cutters. The elements that affect how efficient a bit can be cleaned are fluid turbulence under the bit, fluid velocity under the bit and viscosity of the drilling fluid.

Turbulence is necessary to help pick up broken particles from the drilling surface and, once lifted, keep them in suspension as they are swept toward the pickup aperture of the bit. Fluid velocity helps to create turbulence and currents toward the pickup. Fluid viscosity aids cleaning since the more viscous the fluid, the longer the suspension time of the cuttings.

Fluid velocity and viscosity are also the elements necessary for efficient transport of the cuttings to the surface. Slip velocity must be considered when dealing with the transport of solid particles via a fluid in a vertical stream. Slip velocity describes how fast a particle of a given shape and density will fall through a fluid of a given density and viscosity. To convey cuttings up through the drill pipe via the drilling fluid, which can include air, the fluid velocity must exceed the slip velocity. The more viscous the fluid, the less the fluid velocity must be. Usally the maximum particle load any system can carry is approximately five percent volume. For a given size hole there is an optimum fluid velocity that must be maintained since too much will cause errosion of the bore hole wall.

In holes of small diameter, such as oilwells, direct circulation is used as represented by the illustration in FIG. 1. Direct circulation is the term used when the drilling fluid is pumped down the drill string and returns up the annulus of the bore hole and the drill pipe. Since the cross sectional area is small, the required fluid velocities are easily obtained. However, when drilling holes of large diameter the amount of energy required to maintain particle lift becomes enormous. Under these conditions reverse circulation is used. As the term implies, this is when the drilling fluid and cuttings are returned up the drill pipe. When drilling with direct circulation, mud pumps force the fluid down the drill pipe. When drilling with reverse circulation, an air system is used to lift the fluid up the drill pipe. This system was first developed in 1795 to produce water from wells and underground mines. It works under the same principle that causes champagne to flow from a newly opened bottle.

Air assist reverse circulation systems vary. Single wall, dual wall or triple wall drill pipe can be used. The simplest system is the single wall. In this case, an air line, usually 3-inch pipe if 13⅜-inch drill pipe is used, is run down the drill string approximately 300 feet. Air is injected down this 3-inch pipe. As the air rises it expands forcing fluid up with it. Drilling fluid is returned via the 13⅜-inch drill pipe. In the other two systems, air and drilling fluid are pumped down the drill pipe, either together or separately, and returned up the center. The advantage to these last two systems is that hydraulic energy can be directed on the cutting surface via jets. FIG. 2 illustrates the principles of air assist, reverse circulation.

The drilling system for such a mining operation in accordance with the present invention uses a large diameter drill rig with the diameter of the bit being in excess of 10 feet in diameter, such a drilling has recently been built by Hughes Tool Company under the designation CSD-2020.

In accordance with the drilling operation of the present invention a blind shaft hole is drilled with a diameter in excess of 10 feet that extends to a depth of over 2000 feet utilizing reverse circulation drilling equipment with a high torque drill bit, non-rotating stabilizers and weights all attached at the lower end of a drill string and a fluid circulating mechanism. In carrying out this drilling operation, weights in excess of approximately 300,000 lbs. and non-rotating stabilizers are arranged on the drill string near the bottom of the drill string within approximately 50 feet of the drill bit. Utilizing such a system, the blind mine shaft is drilled. During the drilling operation, the alignment of the drill bit is maintained with the use of the non-rotating stabilizers which have an outer diameter substantially equal to the diameter of the hole being drilled. Fluid is maintained in the drilled hole during the drilling operation at a sufficient level for creating a hydrostatic head for exerting an opposing pressure on any zone of instability in the walls of the drilled hole so as to prevent inflow of water and debris.

During the drilling operation, fluid is circulated through the drill string across the surface of the drill bit with sufficient turbulence so as to clean the drill bit. This fluid is then extracted from the hole for removing broken particles from the drilled hole. The fluid is extracted through an inner cylinder of the drill string with sufficient velocity so as to exceed the slip velocity. In order to assist both in cleaning the drill bit and extracting the broken materials from the drilled hole, air is forced down the drill string through an outer cylinder in the drill string. This air then helps to create a sufficient force for extracting the fluid with the broken material up through the inner cylinder in the drill string. If during the drilling operation, weak permeable spots on the walls of the drilled hole are encountered, such spots can be reinforced by pumping a packing material into such spots when encountered.

The removal of the mineral fragments from the hole is best accomplished by creating a fluid flow through the drilling member in the drilled hole. The flow of fluid carries the mineral fragments out of the hole. This fluid flow can be accomplished by utilizing dual wall string drilling equipment where water is fed into the hole through one chamber of the drill string and the water with the broken mineral fragments is then extracted from the hole through the other chamber of the drill string. The flow of fluid also travels across the cutting surface of the drilling bits so as to constantly wash away the broken mineral fragments so that such fragments are extracted from the hole. In addition, the washing of the cutting surface of the drilling member prevents the drilling member from becoming blocked or clogged by such mineral fragments.

Probably the most generally accepted system used to aid bit cleaning, and to some degree penetration, is the hydraulic jet. Hydraulic jets direct some of the energy of the mud pumps and air compressors against the cutting surface. The jets act to concentrate this energy at particular locations around the bit. This jetting action helps to pick up broken formation from the cutting surface, keeps the cutters from becoming clogged and, in some cases, aids in penetration of soft formations.

As mentioned before, turbulence and fluid velocity are needed for good bit cleaning. Different designs and devices have been experimented with to optimize these conditions. In some designs the cutters have been recessed into the bit body to decrease the cross-sectional area between the cutting surface and the bit. This acts to increase fluid velocity across the bit which increases turbulence. The drawback here is the bit body becoming damaged due to close proximity with the cuttings. Changing cutters is considerably more difficult in this configuration. Other methods have been tried to achieve the same end such as skirts and baffles. Cutter pumps have been used to help keep cutters free of debris. Cutter pumps are designed to employ the turbulance created by rotation of the cutter. Actually they are no more than a housing for cutters within which the turbulance is high due to the small areas enclosed by the housing.

When drilling in an area of the earth containing shale, it is often necessary to use a drilling fluid containing a drilling mud with a salt compound. The salt compound helps to avoid swelling of the shale in the hole being drilled. Two possible salt compounds that can be used are KCL and NaCL. If during the drilling process a water zone is encountered, weighting materials can be added to the drilling fluid. Such weighting materials can include barite which has a specific gravity of 4.5. This helps to avoid a dilution of the fluid within the drilled hole which arises when a water zone with a pressure exceeding the hydrostatic pressure of the drilling fluid is penetrated. If a pressurized zone in the earth is penetrated, this can be detected by monitoring the fluid level within the fluid system. In cases where the hole is completely filled with fluid, the treating tanks can be gauged to detect a change in the system's volume. For situations where the fluid is to remain at a particular depth above the bit or below the surface, there are various types of monitoring devices to ascertain a rise or fall in the fluid level within the hole.

Another potential problem is lost circulation of the drilling fluid. When a highly permeable zone, with a pressure below that of the drilling fluid's hydrostatic pressure is entered, the drilling fluid begins to flow into it. If left unattended, the fluid would continue to drain until equilibrium between the respective pressures is reached. This problem can be dealt with by pumping a plugging or packing material down the hole and out into the face of the highly permeable zone. This will cause the permeability to drop to a fraction of its original state. While just about any type material can be used for such purposes, one primary material would be a grouting material.

The Reynolds number at the surface of the drill bit should be maintained at a minimum of 2000 in order to maintain turbulent flow across the face of the drill bit. The drilling system ideally should be capable of handling a fluid flow rate of approximately 4000 GPM and an air flow rate of approximately 3000 CFM.

Originally, the drilling rigs used in attempting to drill large-diameter holes were converted oil field rigs. These are adequate when dealing with holes around the ten-foot range and under, however, they are seriously limited when attempting holes of larger diameter. To drill holes of 15 to 24 foot diameters a rig had to be designed based on a different set of principles. The rig had to be able to withstand the tremendous torques required of these immense bits. A system capable of delivering torques much greater than could be expected from the traditional rotary table had to be developed. Hoisting capacity had to be about double a standard oil field rig. To meet these demands a hydraulic rig was developed (the main rig assembly has been built by Hughes Tool Company as previously indicated).

This rig, which is illustrated in FIG. 4, stands much shorter than its oil field counterpart, approximately 77 feet high. A hydraulic power swivel, capable of 500,000 ft./lbs. of torque, is used to rotate the drill string. This swivel threads into the box on the drill pipe and travels the length of the mast. This is the reason for the generally squatty appearance. When a new joint of pipe is added, the power swivel is high in the mast. Any excessive torques encountered during drilling operations are restrained by the mast.

Hoisting is done by four hydraulic cylinders. These cylinders are 12 inches in diameter with a 37 foot stroke. Each has a 500,000 lb. capacity yielding a rig capacity of 2,000,000 lbs. This rig is designed to use 20-inch O.D. drill pipe. Each joint is 30 feet long and weighs more than 9,000 lbs. Hydraulic power is supplied by six pumps powered by electric motors. These pumps are mounted on a single skid and are manifolded together. That is, they can be directed in any combination to any part of the rig, hoisting rams, power swivel and so on.

The downhole drilling assembly consists of a drilling mandrel, drill bit, non-rotating stabilizers and weights. The drilling mandrel is a heavy wall 25-foot joint of pipe used to hold the various components together. The bit is attached to a "weight stool." This weight stool has a 132-inch flange that attaches to the bit. The flange is large to accommodate the required drilling torque. The non-rotating stabilizers fit around the weight stool.

Stabilizers are used to control deviation during drilling operations. There are two basic designs: rotating and non-rotating. Rotating stabilizers, as the name implies, are designed to rotate with the drilling assembly. Essentially this is a body built slightly under gauge with cylindrical rollers set around the periphery. Non-rotating stabilizers are designed to remain stationary as the drilling assembly rotates within it. Non-rotating stabilizers offer better protection against hole deviation. This is because of the mechanical action on the bore wall imparted by the rotating style. If a hard zone is encountered and penetration rates drop, this mechanical action may cause the hole to enlarge substantially. This could result in deviation. However, non-rotational stabilizers do not create this agitation, and chances of hole enlargement are diminished.

Ideally, stabilizers should be placed as close to the bit as possible and throughout the drilling assembly. This prevents any buckling of the mandrel, regardless of how slight, that could result in hole deviation. Above the weight stool rests the weights. The weights should be in excess of 300,000 pounds to help ensure that the drill string is always in tension and not compression. The type of weights used are referred to as "split donut weights." These weights are stacked throughout the mandrel. Each weight consists of two to six parts. The weights are split for ease of handling and transportation. Each part interlocks with the others for easy assembly. The total weight of the drilling assembly can be varied by adding or subtracting weights. These weights serve two purposes. First, they create the necessary weight for cutter penetration. Second, the extreme weight produces a "plumb bob" effect to help keep the hole on course. With the "plumb bob" effect, the drill pipe is always in tension, never in compression.

DESCRIPTION OF THE PREFERRED EMBODIMENT

Figure 1:
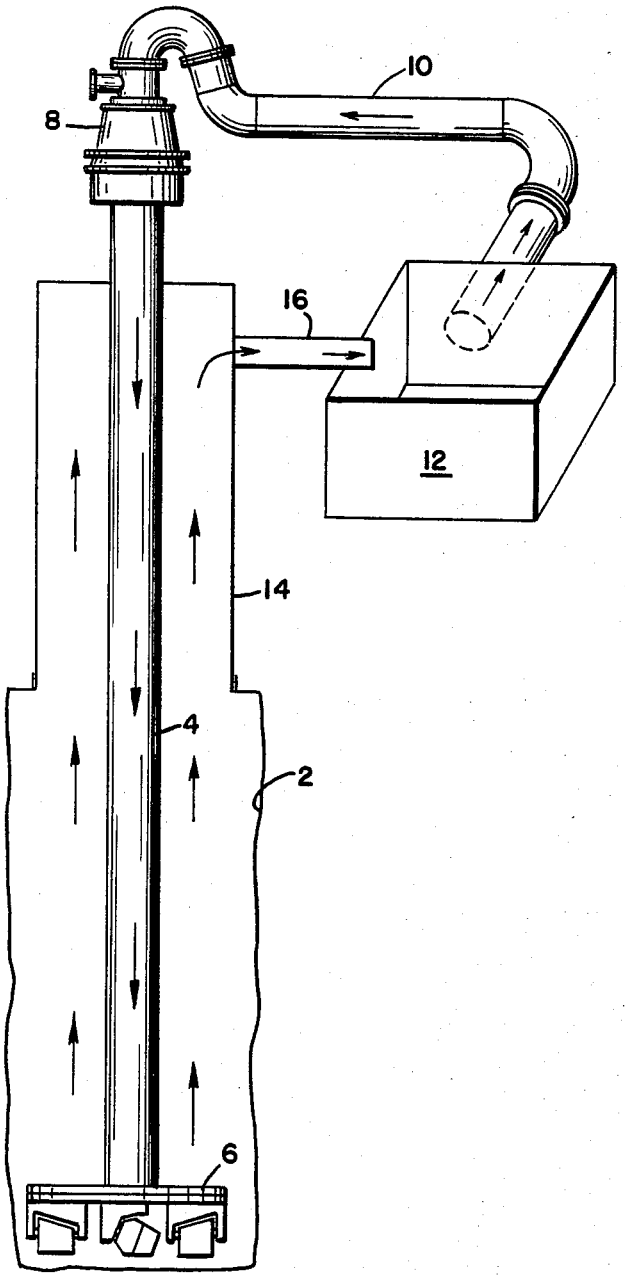
Fig. 1 PRIOR ART
FIG. 1 is a schematic illustration of a drilling system with a conventional fluid circulation mechanism.

A prior art drilling system utilizing direct fluid circulation is schematically illustrated in FIG. 1. Such systems typically are used in drilling relatively small holes, i.e. under 60 inches, to relatively shallow depths. The system shown in FIG. 1 is used in drilling hole 2 in the earth. Drill string 4 which is made up of a plurality of drill string sections couples drill bit 6 to cap 8. Extending a limited distance into the earth near the top of the hole a drilling collar 14 can be provided which helps in stabilizing the alignment of the drilling path during the beginning of the drilling operation. Drilling fluid is supplied from mud system 12 through pipeline 10 down the drill string. This drilling fluid is then extracted with the broken fragments through return line 16 to mud system 10.

Figure 2:
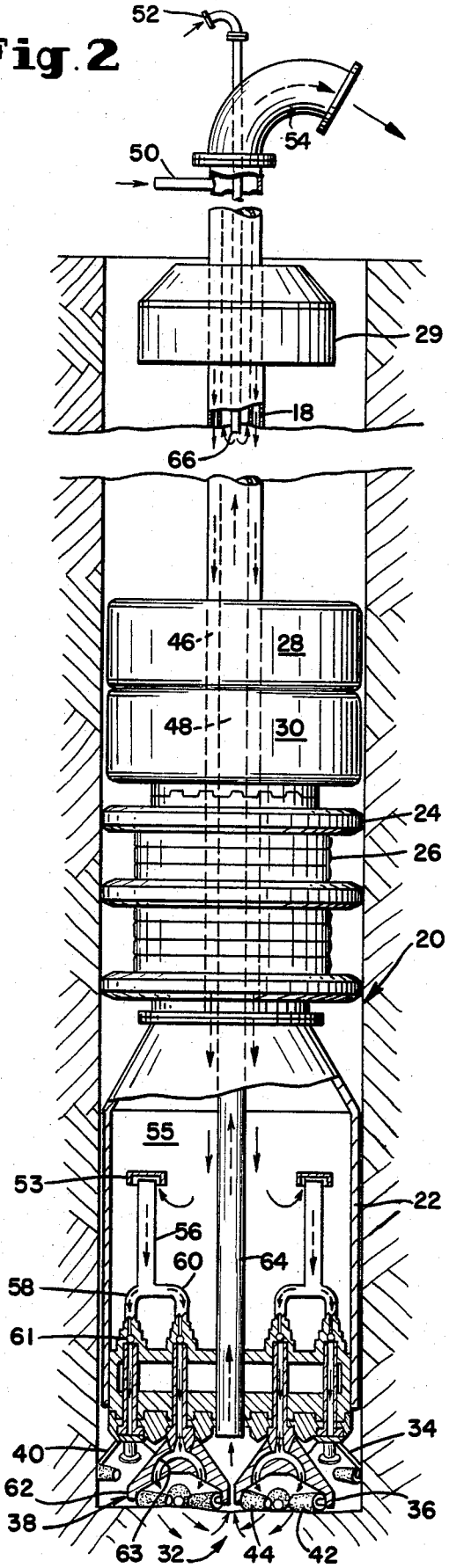
FIG. 2 is a side elevational view partially cut away of a drilling mechanism constructed in accordance with the present invention.

In FIG. 2, one embodiment of the drilling system of the present invention is illustrated. As shown, a drilling mechanism 20 is mounted on drill string member 18 which extends below the ground level. Drilling mechanism 20 includes on its lower end a drilling bit mechanism 22 which has a plurality of individual drilling bits. In order to secure the drilling mechanism against lateral movement during the drilling operation, a plurality of stabilizer members can be arranged around the drill string. Such stabilizing members can include a plurality of stabilizer rings 24 between which there are interspersed a plurality of weights 26. While only one set of stabilizer members have been illustrated, a plurality of such members can be provided.

A plurality of additional circular weights 28 and 30 also are arranged along the drill string in the area adjacent to the drilling bit mechanism. Such weights help to press the drilling bit mechanism with the drilling bits against the bottom of the hole being drilled. Here again a plurality of such weights can be provided depending upon the hardness of the particular earth section being drilled. Mounted above the weights can be additional rollers and circular stabilizing members. At the top of drilling mechanism 20 is a cap 29. In the space between cap 29 and weight 28 surrounding drilling string 18 can either be additional weights and/or additional stabilizer members.

The particular type of drill bit arrangement utilized on drill bit mechanism 22 is a set of gang drill bits 32. The gang drill bit assembly has a plurality of assemblies 34, 36, 38 and 40. Each of these subassemblies of bits is individually rotated by a fluid flow across each assembly. In addition each of the subassemblies has a plurality of rotating individual drill bits such as bits 42 and 44.

In order to drive the drill bits, fluid is fed along the drill string members to the area of the subassemblies. This fluid also serves to remove the drilled out fragments during the drilling operation. Furthermore, the fluid also fills the drilled hole for providing the static balancing force for preventing the walls of the hole from caving in except when desired.

For the purpose of enabling fluid to be fed into the drilled hole and then extracted therefrom, dual wall string members are utilized. The string members that form drill string 18 have an outer chamber 46 and an inner chamber 48. Fluid is fed into outer chamber 46 through fluid inlet 50 which is arranged above the ground. The fluid then travels down along the outer chamber of the dual wall string members until it reaches fluid chamber 55, as shown in FIG. 2. Fluid from chamber 55 then travels under weir 53 into a fluid drive line 56. The fluid flows along drive line 56 and is diverted into two separate lines 58 and 60. The flow of fluid is maintained in only one direction by a ball check valve 61 in order that the fluid along with any drilled fragments cannot flow back into chamber 55 from the area of the drilling operation. The flow of fluid through the line then travels down to the area of the subassemblies. By creating a propelling force along guide impeller 63 and rotating bracket 62, the subassembly is rotated. The fluid also flows over the individual drill bits, such as bits 42 and 44, for rotating these bits. In addition, as the whole subassembly is rotated, the drill bits rotate as they roll along the area being drilled.

As the drilling operation proceeds, the fluid with the drilled fragments are drawn back into the drill string members through a return line 64. Return line 64 leads back into inner chamber 48 of drill string 18. To assist in the withdrawal of the fluid with the fragments from chamber 48, an air pressure force is created by air emitted through outlet 66 of an air line 52. The slurry with the coal fragments is then emitted from the drilling system through an outlet 54.

Figure 3:
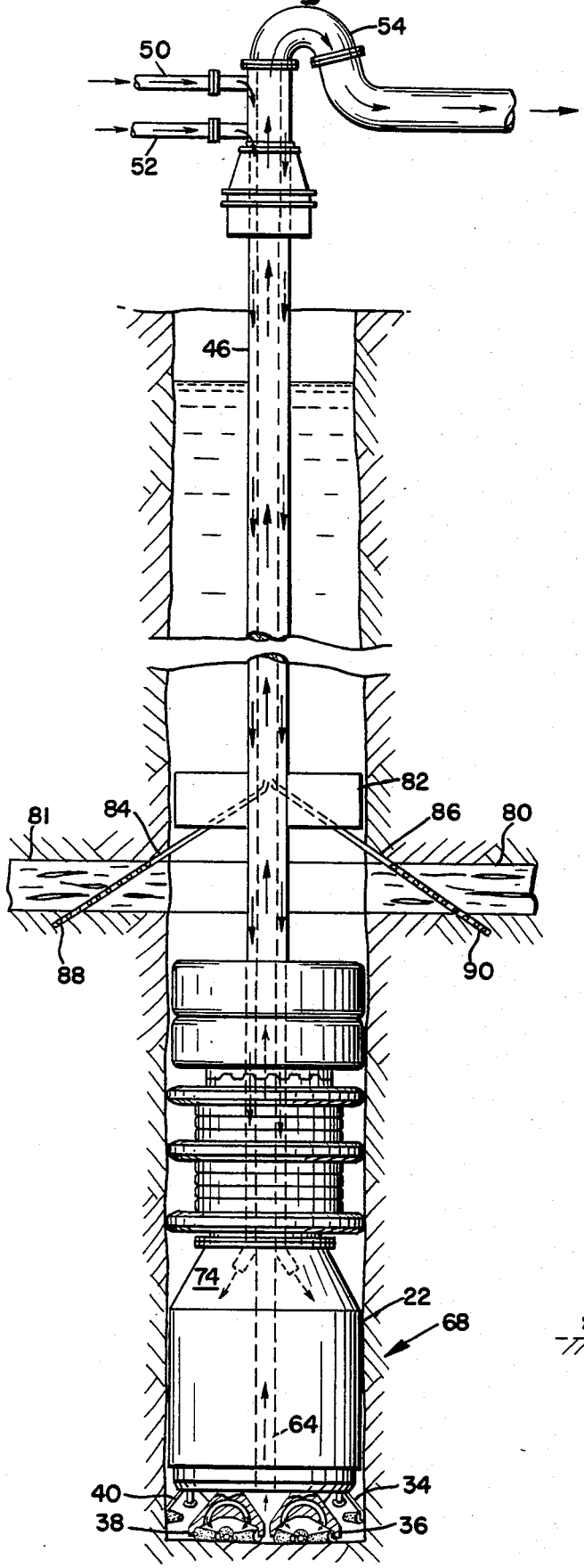
FIG. 3 is a side elevational view partially cut away of a modified embodiment of a drilling mechanism in accordance with the present invention.

A modified embodiment of the drilling mechanism is illustrated in FIG. 3. In this figure those elements that are the same as those in FIG. 2 are identified by the same reference numerals. The two primary distinctions between the drilling mechanism 68 illustrated in FIG. 3 and the drilling mechanism 20 illustrated in FIG. 2 reside in the air flow system that is employed and the employment of a mechanism for packing or plugging the ground surrounding a drilled hole when encountering a water permeable area. In drilling mechanism 68, air is fed in through inlet 52 directly into outer chamber 46 of the drill string member. The air then travels along with the fluid down into chamber 74. Chamber 74 is thus pressurized for helping to force the fluid through the drive line for rotating the drilling bit subassemblies. Air along with the slurry with the broken fragments can be sucked back into line 64 for extracting the fragments. The operation of this modified embodiment of the drilling mechanism is similar to drilling mechanism 20 as previously described above.

The embodiment in FIG. 3 also includes a mechanism for packing or plugging permeable portions in the earth adjacent to the shaft being drilled. When water permeable sections of the earth 80 are encountered, fluid will either leak out of the hole into such sections thereby decreasing the fluid level within the hole or if this permeable area opens into an underground stream fluid will then flow into the hole, again producing an undesirable condition. In both situations, section 80 must be plugged so as to close off such sections. For this purpose, holes can be drilled through conduits 84 and 86 in an angular direction down through sections 80 and 81. After the holes are drilled the holes can be plugged with a grouting material by forcing such grouting material down through conduits 84 and 86 and out through respective openings within the conduits such as represented by openings 88 and 90. By forcing such grouting material down into the drilled holes with a sufficient force permeable sections 80 and 81 are packed and blocked off from the shaft being drilled within the earth.

Figure 4:
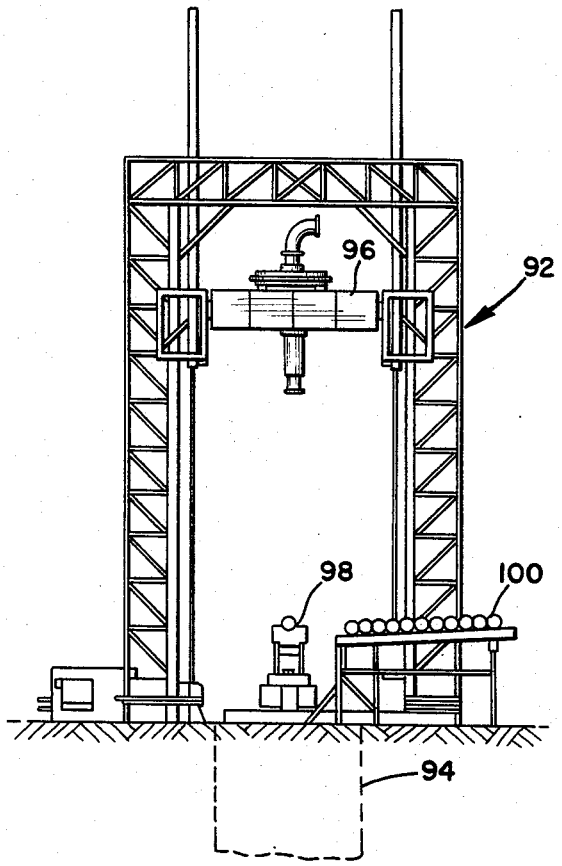
FIG. 4 is a side elevational view of a drilling rig used in the drilling operation of the present invention.

A hydraulic rig 92 that can be used in drilling the shaft in accordance with the present invention is illustrated in FIG. 4. This rig is used with the drilling mechanism such as shown in FIG. 2 or FIG. 3 for drilling shaft 94 within the earth. The drilling rig includes a hoist 96 for lifting the drilling system and advancing the drilling system into the earth as the drilling occurs. One drill string or a pair of drill strings as represented by pipe 98 is fed into alignment with hoist 96. This drill string is then rotated and connected to hoist 96 so that the drilling operation can continue in a forward direction until such drill string has been fed into the earth. Subsequently additional drill strings 100 are added one at a time with hoist mechanism 96 being used for advancing such drill strings and the drill system into the earth for carrying out the drilling operation.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A method of drilling a blind shaft hole having a diameter in excess of 10 feet to a depth of over 2000 ft. utilizing reverse circulation drilling equipment with a high torque drill bit, non-rotating stabilizer rings and weights all attached at the end of a drill string and a liquid circulating mechanism, the method comprising the steps of:

(a) arranging weights in excess of approximately 300,000 pounds and a plurality of non-rotating stabilizer rings on the drill string near the bottom of the drill string within approximately 50 feet of the drill bit, arranging the stabilizer rings on the drill string so as to allow the drill string to rotate within the stabilizer rings while the stabilizer rings do not rotate with respect to the walls of the hole being drilled and therefore such stabilizer rings being non-rotating stabilizer rings;

(b) drilling a blind shaft having a diameter in excess of 10 feet in the earth from the surface of the earth to a depth in excess of 2000 feet;

(c) maintaining the alignment of the drilling bit with the utilization of the non-rotating stabilizer rings which have an outer diameter substantially equal to the diameter of the hole being drilled and are spaced longitudinally along the drill string for providing contact with the walls of the hole at different vertical positions to provide drilling alignment of the bit;

(d) maintaining a liquid in the drilled hole during the drilling operation at a sufficient level for creating a hydrostatic head for exerting an opposing pressure on any zone of instability on the walls of the drilled hole so as to prevent inflow of water and debris;

(e) circulating a liquid through the drill string across the surface of the drill bit with sufficient turbulence so as to clean the drill bit;

(f) extracting liquid from the hole for removing broken materials from the drilled hole, extracting such liquid through an inner cylinder of the drill string with sufficient velocity so as to exceed the slip velocity; and (g) forcing air down the drill string through an outer cylinder in the drill string, such air then helping to create sufficient force for extracting liquid with the broken material up through the inner cylinder in the drill string.

2. A method of drilling according to claim 1 wherein when drilling in an area of the earth containing shale, using a drilling liquid containing a drilling mud with a salt compound added to help avoid swelling of the shale in the hole being drilled.

3. A method for drilling according to claim 2 wherein the salt added to the drilling mud contains KCl.

4. A method for drilling according to claim 2 wherein the salt added to the drilling mud contains NaCl.

5. A method for drilling according to claim 1 wherein when a water zone is encountered during the drilling operation, weighting materials are added to the drilling liquid.

6. A method of drilling according to claim 5 wherein the weighting material includes barite.

7. A method for drilling according to claim 1 further including the step of monitoring the liquid level in the liquid system for determining the encountering of any pressurized zone or highly permeable zone in the earth during the drilling operation.

8. A method for drilling according to claim 1 further including the step of maintaining the Reynolds number at the surface of the drill bit at a minimum of 2000 in order to maintain turbulent flow across the face of the drill bit.

9. A method for drilling according to claim 1 wherein the drilling system utilized is capable of handling a liquid flow rate of approximately 4000 GPM and an air flow rate of approximately 3000 CFM.

10. A method for drilling according to claim 1 wherein a hydraulic jet force is created for providing direct energy of fluid and air against the cutting surface of the drill bit.

11. A method for drilling according to claim 1 further including the step of reinforcing weak permeable spots on the walls of the drilled hole during the drilling operation.

12. A method for drilling according to claim 11 wherein said step of reinforcing permeable spots on the walls is accomplished by pumping materials into such permeable spots in the walls for packing of the walls.

13. A method for drilling according to claim 12 wherein the material pumped into the permeable spots in the walls is a grouting material.

14. A method for drilling according to claim 1 wherein the weights arranged on the drill string are large enough to ensure proper drill bit penetration and to ensure that the drill string is always in tension.

15. A method of drilling a blind shaft hole having a diameter in excess of 10 feet to a depth of over 2000 ft. utilizing reverse circulation drilling equipment with a high torque drill bit, non-rotating stabilizer rings and weights all attached at the end of a drill string and a liquid circulating mechanism, the method comprising the steps of:

(a) arranging weights in excess of approximately 300,000 pounds and a plurality of non-rotating stabilizer rings on the drill string near the bottom of the drill string within approximately 50 feet of the drill bit, arranging the stabilizer rings on the drill string so as to allow the drill string to rotate within the stabilizer rings while the stabilizer rings do not rotate with respect to the walls of the hole being drilled and therefore such stabilizer rings being non-rotating stabilizer;

(b) drilling a blind shaft having a diameter in excess of 10 feet in the earth from the surface of the earth to a depth in excess of 2000 feet;

(c) maintaining the alignment of the drilling bit with the utilization of the non-rotating stabilizer rings which have an outer diameter substantially equal to the diameter of the hole being drilled and are spaced longitudinally along the drill string for providing contact with the walls of the hole at different vertical positions to provide drilling alignment of the bit;

(d) maintaining liquid in the drilled hole during the drilling operation at a sufficient level for creating a hydrostatic head for exerting an opposing pressure on any zone of instability on the walls of the drilled hole so as to prevent inflow of water and debris;

(e) circulating liquid through the drill string across the surface of the drill bit with sufficient turbulence so as to clean the drill bit;

(f) extracting liquid from the hole for removing broken materials from the drilled hole, extracting such liquid through an inner cylinder of the drill string with sufficient velocity so as to exceed the slip velocity;

(g) forcing air down the drill string through an outer cylinder in the drill string, such air then helping to create sufficient force for extracting liquid with the broken material up through the inner cylinder in the drill strings; and (h) reinforcing weak permeable spots on the walls of the drilled hole by pumping a packing material into such spots when encountered during the drilling operation.

16. A method of drilling a blind shaft hole having a diameter in excess of 15 feet to a depth of over 2000 ft. utilizing reverse circulation drilling equipment with approximately at least 500,000 ft./lb. operating torque and 2,500,000 lifting capacity and having a high torque drill bit, non-rotating stabilizer rings and weights all attached at the end of a drill string and a liquid circulating mechanism, the method comprising the steps of:

(a) arranging weights in excess of approximately 300,000 pounds and a plurality of non-rotating stabilizer rings on the drill string near the bottom of the drill string within approximately 50 feet of the drill bit with the total weight of the drill bit section with weights and stabilizers being in excess of 750,000 lb., arranging the stabilizer rings on the drill string so as to allow the drill string to rotate within the stabilizer rings while the stabilizer rings do not rotate with respect to the walls of the hole being drilled and therefore such stabilizer rings being non-rotating stabilizer rings;

(b) drilling a blind shaft having a diameter in excess of 15 feet in the earth from the surface of the earth to a depth in excess of 2000 feet;

(c) maintaining the alignment of the drilling bit with the utilization of the non-rotating stabilizer rings which have an outer diameter substantially equal to the diameter of the hole being drilled and are spaced longitudinally along the drill string for providing contact with the walls of the hole at different vertical positions to provide drilling alignment of the bit;

(d) maintaining liquid in the drilled hole during the drilling operation at a sufficient level for creating a hydrostatic head for exerting an opposing pressure on any zone of instability on the walls of the drilled hole so as to prevent inflow of water and debris;

(e) circulating liquid through the drill string across the surface of the drill bit with sufficient turbulence so as to clean the drill bit;

(f) extracting liquid from the hole for removing broken materials from the drilled hole, extracting such liquid through an inner cylinder of the drill string with sufficient velocity so as to exceed the slip velocity; and (g) forcing air down the drill string through an outer cylinder in the drill string, such air then helping to create sufficient force for extracting liquid with the broken material up through the inner cylinder in the drill string.

17. A method of drilling according to claim 15 or 16 wherein when drilling in an area of the earth containing shale, using a drilling liquid containing a drilling mud with a salt compound added to help avoid swelling of the shale in the hole being drilled.

18. A method for drilling according to claim 17 wherein the salt added to the drilling mud contains KCl.

19. A method for drilling according to claim 17 wherein the salt added to the drilling mud contains NaCl.

20. A method for drilling according to claim 15 or 16 wherein a water zone is encountered during the drilling operation, weighting materials are added to the drilling liquid.

21. A method of drilling according to claim 20 wherein the weighting material includes barite.

22. A method for drilling according to claim 15 or 16 further including the step of monitoring the fluid level in the liquid system for determining the encountering of any pressurized zone or highly permeable zone in the earth during the drilling operation.

23. A method for drilling according to claim 15 or 16 further including the step of maintaining the Reynolds number at the surface of the drill bit at a minimum of 2000 in order to maintain turbulent flow across the face of the drill bit.

24. A method for drilling according to claim 15 or 16 wherein the drilling system utilized is capable of handling a liquid flow rate of approximately 4000 GPM and an air flow rate of approximately 3000 CFM.

25. A method for drilling according to claim 15 or 16 utilizing a concave drill bit with the cutters of the periphery approaching the formations first followed by the center cutters.

26. A method for drilling according to claim 15 or 16 utilizing a flat faced drill bit.

27. A method for drilling according to claim 15 or 16 wherein a hydraulic jet force is created for providing direct energy of liquid and air against the cutting surface of the drill bit.

28. A method for drilling according to claim 16 further including the step of reinforcing weak permeable spots on the walls of the drilled hole during the drilling operation.

29. A method for drilling according to claim 28 wherein said step of reinforcing permeable spots on the walls is accomplished by pumping materials into such permeable spots in the walls for packing of the walls.

30. A method for drilling according to claim 29 wherein the material pumped into the permeable spots in the walls is a grouting material.

31. A method for drilling according to claim 15 or 16 wherein the weights arranged on the drill string are large enough to ensure proper drill bit penetration and to ensure that the drill string is always in tension.

32. Apparatus for drilling a blind shaft hole having a diameter in excess of 10 feet to a depth of over 2000 ft., said apparatus comprising:

(a) reverse circulation drilling means including a high torque drill bit and a plurality of non-rotating stabilizer rings attached at the end of a drill string, arranging the stabilizer rings on the drill string so as to allow the drill string to rotate within the stabilizer rings while the stabilizer rings do not rotate with respect to the walls of the hole being drilled and therefore such stabilizer rings being non-rotating stabilizer rings;

(b) weights in excess of approximately 300,000 pounds along said non-rotating stabilizer rings being arranged on said drill string near the bottom of said drill string within approximately 50 feet of said drill bit;

(c) said non-rotating stabilizer rings having an outer diameter substantially equal to the diameter of the hole being drilled and spaced longitudinally along said drill string for providing contact with the walls of the hole at different vertical positions for maintaining the alignment of the drilling bits;

(d) means for maintaining fluid in the drilled hole during the drilling operation at a sufficent level for creating a hydrostatic head for exerting an opposing pressure on any zone of instability on the walls of the drilled hole so as to prevent inflow of water and debris;

(e) liquid circulating means for circulating liquid through said drill string across the surface of said drill bit with sufficient turbulence so as to clean said drill bit;

(f) liquid extracting means for extracting liquid from the hole for removing broken materials from the drilled hole, extracting such liquid through an inner cylinder of the drill string with sufficient velocity so as to exceed the slip velocity;

(g) air supply means for forcing air down the drill string through an outer cylinder in the drill string, such air then helping to create sufficient force for extracting liquid with the broken material up through the inner cylinder in the drill string; and (h) means for reinforcing weak permeable spots on the walls of the drilled hole by pumping a packing material into such spots when encountered during the drilling operation.

33. A method of drilling a blind shaft hole utilizing reverse circulation drilling equipment with a high torque drill bit attached at the end of a drill string and a liquid circulating mechanism, the method comprising:

(a) arranging a plurality of non-rotating stabilizer rings on the drill string near the bottom thereof adjacent to the drill bit so as to allow the drill string to rotate with the stabilizer rings while the stabilizer rings do not rotate with respect to the walls of the hole being drilled;

(b) drilling a blind shaft having a diameter in excess of 10 feet in the earth from the surface of the earth to a depth in excess of 2000 feet;

(c) maintaining the alignment of the drilling bit with the utilization of the non-rotating stabilizer rings which have an outer diameter substantially equal to the diameter of the hole being drilled and are spaced longitudinally along the drill string for providing contact with the walls of the hole at different vertical positions to provide drilling alignment of the bit;

(d) maintaining a liquid in the drilling hole during the drilling operation at a sufficient level for creating a hydrostatic head for exerting an opposing pressure on zones of instability on the walls of the drilling hole so as to prevent inflow of water and debris;

(e) circulating a liquid through the drill string across the surface of the drill bit with sufficient turbulence so as to clean the drill bits;

(f) extracting liquid from the hole for removing broken materials from the drilling hole, extracting such liquid through an inner cylinder of the drill string with sufficient velocity so as to exceed the slip velocity; and (g) forcing air down the drill string through an outer cylinder in the drill string for aiding the extracting of liquid and contained broken material up through the inner cylinder in the drill string.

34. Apparatus for drilling a blind shaft hole having a diameter in excess of 10 feet, said apparatus comprising:

(a) reverse circulation drilling means including a high torque drill bit and a plurality of non-rotating stabilizer rings attached at the end of a drill string and arranged so as to allow the drill string to rotate with the stabilizer rings while the stabilizer rings do not rotate with respect to the walls of the holes being drilled;

(b) said non-rotating stabilizer rings having an outer diameter substantially equal to the diameter of the hole being drilled and spaced longitudinally along said drill string near the bottom of said drill string adjacent to the drill bit for providing contact with the walls of the hole at different vertical positions and for maintaining the alignment of the drilling bit;

(c) means for maintaining fluid in the drilling hole during the drilling operation at a sufficient level for creating a hydrostatic head for exerting an opposing pressure on any zone of instability on the walls of the drilling hole so as to prevent inflow of water and debris;

(d) liquid circulating means for circulating liquid through said drill string across the surface of said drill bit with sufficient turbulence so as to clean said drill bit;

(e) liquid extracting means for extracting liquid from the hole for removing broken materials from the drilled hole, extracting such liquid through an inner cylinder of the drill string with sufficient velocity so as to exceed the slip velocity; and (f) air supply means for forcing air down the drill string through an outer cylinder in the drill string to create sufficient force for extracting liquid containing broken material up through the inner cylinder in the drill string.

* * * * *

UNITED STATES PATENT AND TRADEMARK OFFICE

CERTIFICATE OF CORRECTION

PATENT NO. : 4,516,633

DATED : May 14,1985

INVENTOR(S) : Paul Richardson et al

It is certified that error appears in the above-identified patent and that said Letters Patent is hereby corrected as shown below:

In the first publication listed on the Abstract page, Insert after "Whitley," the following --Fifth Annual District Four Meeting, Canadian Institute of Mining,--.

Signed and Sealed this

*First* Day of *October 1985*

[SEAL]

*Attest:*

DONALD J. QUIGG

*Attesting Officer*

*Commissioner of Patents and Trademarks—Designate*